US009267405B2

(12) United States Patent
Jessberger et al.

(10) Patent No.: US 9,267,405 B2
(45) Date of Patent: Feb. 23, 2016

(54) CONTROL HOUSING COVER FOR AN INTERNAL COMBUSTION ENGINE

(71) Applicant: MANN+HUMMEL GMBH, Ludwigsburg (DE)

(72) Inventors: Thomas Jessberger, Asperg (DE); Michael Daiber, Ludwigsburg (DE); Holger Beyerlin, Rutesheim (DE)

(73) Assignee: MANN + HUMMEL GMBH, Ludwigsburg (DE)

( * ) Notice: Subject to any disclaimer, the term of this patent is extended or adjusted under 35 U.S.C. 154(b) by 0 days.

(21) Appl. No.: 14/200,750

(22) Filed: Mar. 7, 2014

(65) Prior Publication Data

US 2014/0182525 A1 Jul. 3, 2014

Related U.S. Application Data

(63) Continuation of application No. PCT/EP2012/066177, filed on Aug. 20, 2012.

(30) Foreign Application Priority Data

Sep. 8, 2011 (DE) ..... 10 2011 112 585

(51) Int. Cl.
*F01M 13/00* (2006.01)
*F01M 13/04* (2006.01)
*F02F 7/00* (2006.01)

(52) U.S. Cl.
CPC ..... *F01M 13/0405* (2013.01); *F02F 7/0007* (2013.01); *F02F 2007/0075* (2013.01)

(58) Field of Classification Search
CPC ..... F01M 13/04; F01M 13/0405; F02F 2007/0075; F02F 7/0007
USPC ..... 123/41.86, 572–574
See application file for complete search history.

(56) References Cited

U.S. PATENT DOCUMENTS

| | | | | |
|---|---|---|---|---|
| 6,047,668 | A * | 4/2000 | Yamamoto et al. | 123/2 |
| 6,182,624 | B1 * | 2/2001 | Ozeki | 123/90.33 |
| 6,854,454 | B2 * | 2/2005 | Obayashi et al. | 123/572 |
| 6,899,091 | B2 * | 5/2005 | Akiyama | F01M 13/04 123/41.86 |
| 7,032,555 | B2 * | 4/2006 | Francis | F01M 11/02 123/195 C |
| 2009/0071448 | A1 * | 3/2009 | Smith | F02M 37/20 123/516 |
| 2009/0188465 | A1 * | 7/2009 | Iwata | F02F 7/0073 123/195 C |
| 2009/0205618 | A1 | 8/2009 | Hirota | |
| 2009/0241919 | A1 * | 10/2009 | Janssen et al. | 123/572 |

FOREIGN PATENT DOCUMENTS

| | | | | |
|---|---|---|---|---|
| DE | 10160882 | A1 | 6/2003 | |
| DE | 102008021055 | A1 * | 10/2009 | F01M 13/0011 |
| GB | 769647 | A | 3/1957 | |
| JP | 2010090802 | A | 4/2010 | |

OTHER PUBLICATIONS

DE 102008021055A1 translated from EPO website www.epo.org.*

* cited by examiner

*Primary Examiner* — John Kwon
*Assistant Examiner* — James Kim
(74) *Attorney, Agent, or Firm* — James Hasselbeck

(57) ABSTRACT

A control housing cover for an internal combustion engine includes an engine block cover portion having a plurality of apertures, an oil separator for blow-by gases integrated into the control housing cover, an engine support plate operable for securing supporting the internal combustion engine in place and wherein the oil separator is arranged neighboring the engine support plate.

10 Claims, 2 Drawing Sheets

CONTROL HOUSING COVER FOR AN INTERNAL COMBUSTION ENGINE

CROSS-REFERENCE TO RELATED APPLICATIONS

This application is a continuation application of international application No. PCT/EP2012/066177 having an international filing date of Aug. 20, 2012 and designating the United States, the international application claiming a priority date of Sep. 8, 2011, based on prior filed German patent application No. 10 2011 112 585.3, the entire contents of the aforesaid international application and the aforesaid German patent application being incorporated herein by reference.

TECHNICAL FIELD

The invention concerns a control housing cover for an internal combustion engine according to the preamble of claim 1.

BACKGROUND

DE 10 2008 021 055 A1 discloses a control housing cover for an internal combustion engine that is arranged laterally on the engine block and covers the timing chain of the internal combustion engine. A crankcase venting device is integrated in the control housing cover by means of which oil particles from the blow-by gases of the crankcase of the internal combustion engine are separated wherein the gases are supplied to the intake manifold of the internal combustion engine after oil separation. The crankcase venting device comprises an oil separator that is insertable into a receptacle in the control housing cover that is located in the lateral area of the control housing cover. An oil drain line for separated oil branches off the oil separator in downward direction and a return line for the purified blow-by gases in upward direction. All components of the crankcase venting device, i.e., the oil separator as well as the oil drain line and the return line, are arranged in the lateral area of the control housing cover wherein care is to be taken that guiding of the timing chain is not impaired by the components of the crankcase venting device. For avoiding this problem, the control cover housing must have a relatively great width in order to be able to receive the crankcase venting device without impairing the timing chain.

SUMMARY OF THE INVENTION

It is the object of the invention to provide with simple constructive measures a compactly designed control housing cover for an internal combustion engine with integrated oil separator of a crankcase venting device.

According to the invention, this object is solved with the features of claim 1. The dependent claims disclose expedient further embodiments.

The control housing cover is connected by a flange laterally to the engine block of an internal combustion engine and comprises an engine support plate which serves for holding the internal combustion engine. By means of the engine support plate, the engine is connected within the engine compartment of a motor vehicle. The control housing cover accommodates also an oil separator of a crankcase venting device in order to separate oil particles from the blow-by gases of the crankcase of the internal combustion engine, wherein the purified gases are supplied subsequently to the intake manifold of the internal combustion engine. The oil separator is integrated into the control cover housing; the separation of oil particles from the blow-by gases is realized by the oil separator. The oil separator is arranged neighboring the engine support plate.

The control housing cover in this embodiment can be of a compact design. The engine support plate which is formed monolithically with the control housing cover or is fixedly connected thereto is located in a position in the control housing cover in which guiding and moving of the timing chain, which is covered by the control housing cover, are not impaired. Accordingly, positioning the oil separator adjacent to the engine support plate does not cause an impairment of the timing chain. As a whole, the integration of the oil separator is realized without changing the dimensions of the control housing cover in that the existing space in immediate vicinity of the engine support plate is utilized for receiving the oil separator.

According to an expedient embodiment, the engine support plate and the oil separator, viewed in transverse direction of the control housing cover, are centrally arranged. The engine support plate is expediently positioned at a 90° angle relative to the plane of the control housing cover; the engine support plate projects horizontally past the front side of the control housing cover. This has the advantage that these two components are located outside of the circulating timing chain and that no modifications are required for guiding the timing chain. The oil separator can be integrated without changing the height or width of the control housing cover.

In vertical direction, the engine support plate can be arranged immediately below a camshaft bearing for supporting the camshaft of the internal combustion engine. Inasmuch as the internal combustion engine is provided with two camshafts, the two camshaft bearings are usually positioned adjacent to each other; the engine support plate is positioned below the two camshaft bearings. The timing chain is guided about the camshafts received in the camshaft bearings and drives them.

The oil separator is expediently arranged immediately on the engine support plate; it is positioned in particular below the engine support plate. In addition to the oil separator, the crankcase venting device may have correlated therewith a closure valve, in particular a mechanically acting passive pressure control valve that is positioned in the flow path of the blow-by gases and, depending on the differential pressure upstream and downstream of the valve, switches between a closed and an open position. The oil separator and the closure valve are located preferably on opposite sides of the engine support plate in which an opening may be provided through which the blow-by gases are guided from the oil separator to the closure valve. By means of the arrangement of the closure valve and of the oil separator on opposite sides of the engine support plate, a further advantage is provided, aside from a compact integration into the control housing cover, in that the heat which is released by the internal combustion engine prevents freezing of movable components of the crankcase venting device, in particular of the valve body of the closure valve.

The oil separator has at least one oil separating unit in a housing which is insertable into the receiving opening or receiving space in the control housing cover. The receiving opening is preferably accessible by means of the inner side of the control housing cover that is facing the internal combustion engine so that the oil separator is shielded relative to the exterior side by the control housing cover and the engine support plate. During installation, the oil separator is inserted via the inner side into the receiving opening in the control housing cover. Expediently, the engine support plate forms a boundary wall of the receiving opening in the control housing cover.

The oil separator comprises expediently a coarse oil separating unit and a fine oil separating unit through which the blow-by gases are guided in this sequence before they are supplied via the closure valve to the intake manifold of the internal combustion engine. The timing chain which is circulating in the oil bath is positioned in the intake area of the oil separator so that by means of the coarse and fine oil separating units an effective separation of the oil-containing crankcase gases can be achieved.

The oil separator is expediently inserted as a pre-assembled unit into the receiving opening in the control housing cover and is secured thereat by suitable measures such as screws, welds, gluing, clip-on action or the like. Optionally, the components of the oil separator can also be inserted immediately into the receiving opening in the control housing cover and secured therein, for example, by welding.

Expediently, the components of the crankcase venting device are sealed pressure-tightly for improving the separating performance, in particular the connection between the fine oil separating unit of the oil separator and the closure valve.

BRIEF DESCRIPTION OF THE DRAWINGS

Further advantages and expedient embodiments can be taken from the further claims, the figure description, and the drawings. It is shown in:

In the Figures, same components are identified with same reference characters.

PREFERRED EMBODIMENT(S) OF THE INVENTION

Figure 1:
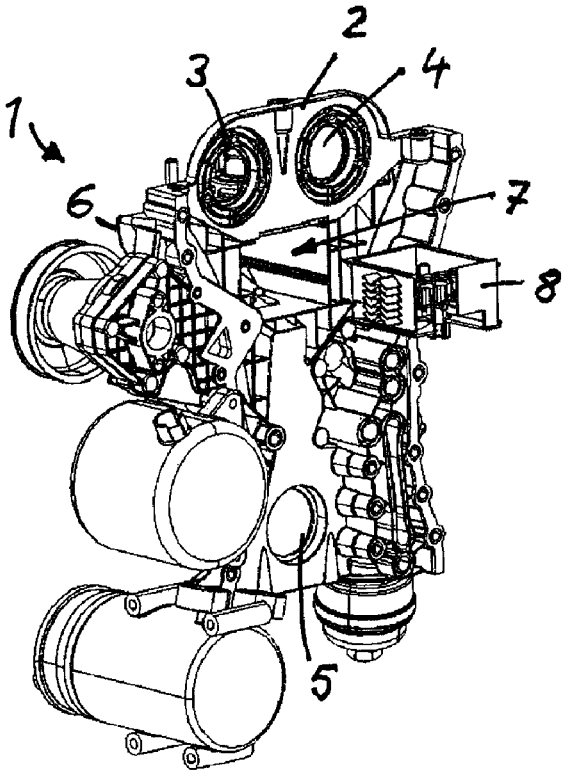
FIG. 1 a control housing cover for an internal combustion engine in a perspective rear view.
Figure 2:
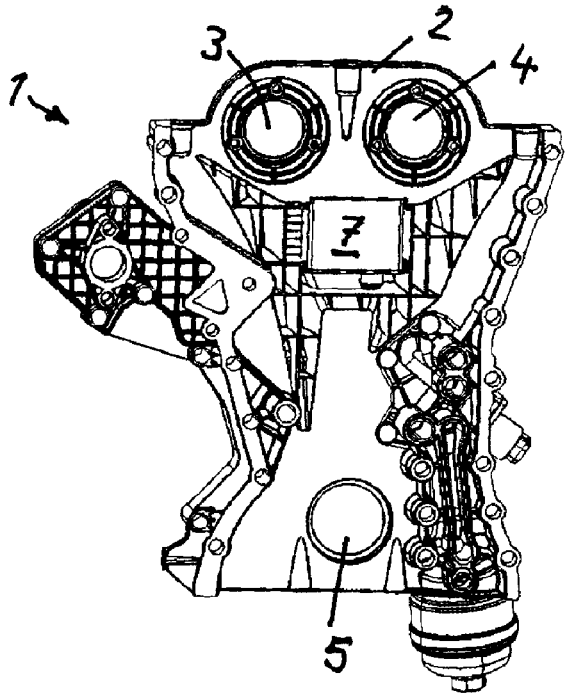
FIG. 2 the control housing cover in a direct rear view.

In the Figures, a control housing cover 1 for an internal combustion engine is illustrated. The control housing cover 1 has in the upper section a camshaft support plate 2 with two camshaft bearing cutouts 3 and 4 provided therein for supporting and sealing parallel-arranged camshafts. In the lower section of the control housing cover 1, there is a further receptacle 5 that forms a crankshaft bearing cutout for receiving and supporting the crankshaft of the internal combustion engine. Adjacent to the control housing cover 1, the camshafts and the crankshaft are engaged by a timing chain which is driven by the crankshaft and transmits the drive movement onto the camshafts.

At the front side, an engine support plate 6 is provided which is formed monolithically with the control housing cover 1 and, relative to the vertical plane of the control housing cover 1, is oriented at a 90° angle and projects horizontally forwardly. By means of the engine support plate 6, the internal combustion engine is secured in the engine compartment of the motor vehicle. The engine support plate 6 extends immediately below the two camshaft bearing cutouts 3 and 4.

Below the engine support plate 6, at the rear or inner side of the control housing cover 1, a receiving opening 7 is provided into which an oil separator 8 is insertable which is a component of a crankcase venting device for purifying crankcase or blow-by gases and transferring the purified gases into the intake manifold of the internal combustion engine. The receiving opening 7 is positioned immediately below the engine support plate 6 which delimits the receiving opening 7 in upward direction. In the inserted state, the oil separator 8 is positioned immediately below the engine support plate 6. The receiving opening 7 is accessible only through the inner side of the control housing cover 1; at the front side, the receiving opening 7 is closed off so that the oil separator 8 is received safely in the receiving opening 7.

The engine support plate 6 and the receiving opening 7 are positioned, relative to the transverse direction, centrally or symmetrically on the control cover housing 1. The engine support plate is located on the front side of the control housing cover that is facing away from the internal combustion engine, the receiving opening or the receiving space for receiving the oil separator, which is located immediately adjacent to the engine support plate, is therefore also located at the front side and thus outside of the movement space of the timing chain so that there is no impairment at the inner or rear side of the control housing cover for the guiding action of the timing chain.

Figure 3:
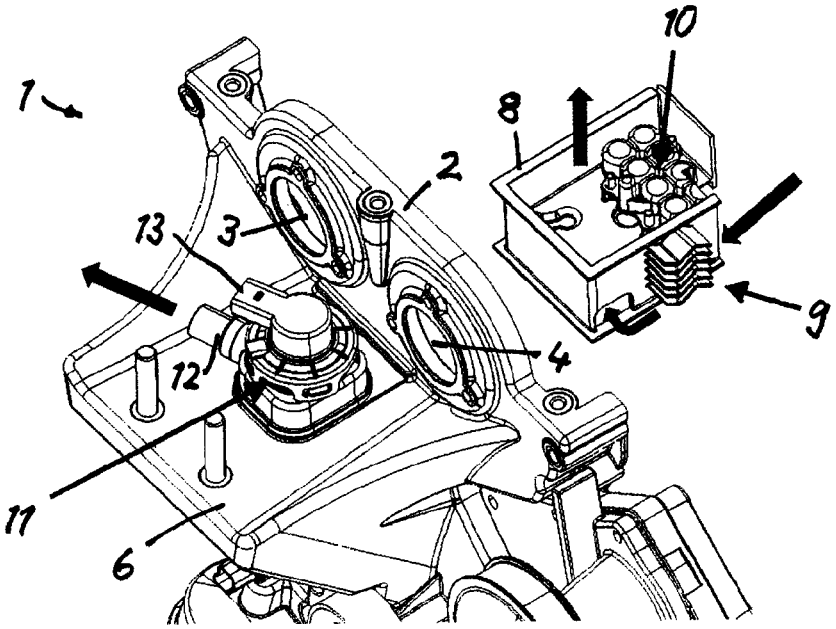
FIG. 3 in perspective illustration the upper front part of the control housing cover and an oil separator of a crankcase venting device which is insertable into a receiving opening in the control housing cover.

As can be seen in FIG. 3, the oil separator 8 has a housing with a coarse oil separating unit and a fine oil separating unit 10. The oil separator forms together with the housing and the coarse and fine oil separation units 9, 10 a pre-assembled unit which is insertable into the receiving opening 7 via the rear side of the control housing cover and is to be mechanically attached thereat with suitable measures, for example, by welding or gluing.

The crankcase venting device has moreover a closure valve embodied as a pressure control valve that is arranged on the topside of the engine support plate 6 positioned opposite the oil separator 8. The pressure control valve 11 controls the pressure in the oil separator 8 and on the inner side of the control housing cover 1 to a defined pressure level. With decreasing pressure at the clean gas socket 12, the valve member carries out a lifting stroke movement and reduces thereby the flow passage cross-section so that the pressure loss of the pressure control valve 11 is increased.

With bold arrows, the air guiding action for the blow-by gases is illustrated. First, the blow-by gases that are originating in the crankcase are guided through the coarse oil separating unit 9 that is located at the exterior side of the housing of the oil separator 8. Subsequently, the air stream is passed into the housing interior and the fine oil separating unit 10 arranged therein. During the further course, the purified air stream is passed from the housing interior of the oil separator 8 in upward direction through an opening in the engine support plate 6 to the pressure control valve 11 positioned above and in the direction toward clean gas socket 12 during the further course.

FIG. 3 shows also that immediately above the outflow socket 12 on the housing of the pressure control valve 11 a laterally projecting connecting socket 13 is provided through which electrical lines of a sensor can be passed by means of which the actual position of the valve body of the pressure control valve can be detected.

The invention claimed is:

1. Control housing cover for an internal combustion engine, comprising:

an engine block cover portion having a plurality of apertures, the engine block cover portion having an inward side configured to mount onto the internal combustion engine and an opposing front/outer side;

an oil separator receiving chamber provided in the control housing cover, the oil separator receiving chamber arranged on a front/outer side of the control housing cover and protruding outwardly away from the front/outer side of the control housing cover;

an oil separator receiving opening extending through the control housing cover from an inward side of the control housing cover into the oil separator receiving chamber, wherein the oil separator receiving chamber at the front/outer side of the control housing cover is closed off such the receiving chamber is accessible only through the oil separator receiving opening at the inward side of the control housing cover;

a crankcase venting device integrated into the control housing cover (1), the crankcase venting device including an oil separator (8) inserted into the oil separator receiving chamber through the oil separator receiving opening arranged at the inward side of the control housing cover facing the engine;

an engine support plate (6) arranged on and secured onto the front/outer side of the engine block cover portion and extending therefrom outwardly away from the engine, the engine support plate configured to hold and securely mount the engine;

wherein the oil separator (8) for removing oil from blow-by gases is arranged directly underneath the engine support plate (6) at the front/outer side of the engine block cover portion;

wherein the engine support plate forms a top wall of the oil separator;

wherein clean gases from the oil separator exit through a clean gas opening in the engine support.

2. The control housing cover according to claim 1, wherein the engine support plate (6) and the oil separator (8) are arranged centrally on the control housing cover (1).

3. The control housing cover according to claim 1, wherein one of the apertures in the engine block cover portion is a camshaft bearing cutout (3, 4);

wherein the engine support plate (6) is arranged on the front/outer side of the engine block cover portion immediately below the camshaft bearing cutout (3, 4), the engine support plate extending outwardly away from the engine on the front/outer side of the engine block cover portion.

4. The control housing cover according to claim 3, wherein wherein a direction of extension of an inner side of the engine block cover portion of the control housing cover (1) is substantially planar;

wherein the engine support plate (6) is positioned at a 90 degree angle relative to the plane of the control housing cover (1).

5. The control housing cover according to claim 1, wherein the crankcase venting device comprises:

the oil separator (8); and a closing valve (11);

wherein the oil separator (8) is arranged immediately at one side of the engine support plate and the closing valve (11) is are arranged on an oppositely positioned side of the engine support plate (6).

6. The control housing cover according to claim 5, wherein wherein the engine support plate clean gas opening conducts blow-by gases from the oil separator (8) arranged immediately at one side of the engine support plate to the closing valve (11) arranged on at the oppositely positioned side of the engine support plate.

7. The control housing cover according to claim 1, wherein the oil separator (8) comprises a coarse oil separating unit (9); and a fine oil separating unit (10).

8. The control housing cover according to claim 1, wherein the engine support plate (6) and the oil separator (8) are arranged centrally on the control housing cover (1);

wherein one of the apertures in the engine block cover portion is a camshaft bearing cutout (3, 4);

wherein the engine support plate (6) is arranged on the engine block cover portion immediately below the camshaft bearing cutout (3, 4);

wherein the engine support plate (6) is positioned at a 90 degree angle relative to a plane of extension of the control housing cover (1);

wherein the crankcase venting device comprises:

the oil separator (8); and a closing valve (11);

wherein the oil separator (8) is arranged immediately at one side of the engine support plate and the closing valve (11) is are arranged on an oppositely positioned side of the engine support plate (6);

wherein the engine support plate clean gas opening conducts blow-by gases from the oil separator (8) arranged immediately at one side of the engine support plate to the closing valve (11) arranged on at the oppositely positioned side of the engine support plate;

wherein a receiving opening (7) is provided in an inner side of the engine block cover portion of the control housing cover;

wherein the oil separator (8) is arranged in the receiving opening;

wherein the oil separator (8) is accessible via an inner side of the control housing cover facing the internal combustion engine;

wherein the oil separator (8) comprises a coarse oil separating unit (9); and a fine oil separating unit (10).

9. An internal combustion engine comprising a control housing cover according to claim 1.

10. An oil separator of a crankcase venting device, comprising:

a coarse oil separating unit (9); and a fine oil separating unit (10);

wherein the oil separator (8) is integrated into a control housing cover (1) according to claim 1.

* * * * *